US005838349A

United States Patent [19]

Choi et al.

[11] Patent Number: 5,838,349

[45] Date of Patent: Nov. 17, 1998

22

[54] ELECTROHYDRODYNAMIC INK JET PRINTER AND PRINTING METHOD

[75] Inventors: Dong Ho Choi, Palo Alto; Ian R. Smith, Los Gatos, both of Calif.

[73] Assignee: Natural Imaging Corporation, Palo Alto, Calif.

[21] Appl. No.: 787,185

[22] Filed: Jan. 21, 1997

Related U.S. Application Data

[63] Continuation of Ser. No. 261,543, Jun. 17, 1994, abandoned.

[51] Int. Cl.[6] ..... B41J 2/41

[52] U.S. Cl. ..... 347/55; 347/43

[58] Field of Search ..... 347/55, 43, 115, 347/116, 151

[56] References Cited

U.S. PATENT DOCUMENTS

| | | | |
|---|---|---|---|
| 2,600,129 | 6/1952 | Richards . | |
| 2,932,548 | 4/1960 | Nau | 347/55 |
| 3,060,429 | 10/1962 | Winston . | |
| 3,673,601 | 6/1972 | Hertz | 347/55 |
| 3,689,935 | 9/1972 | Pressman et al. | 347/55 |
| 3,893,126 | 7/1975 | Ascoli et al. | 347/82 |
| 4,314,263 | 2/1982 | Carley | 347/55 X |
| 4,403,228 | 9/1983 | Miura et al. | 347/55 |
| 4,403,234 | 9/1983 | Miura et al. | 347/55 |
| 4,555,717 | 11/1985 | Miura et al. | 347/55 X |
| 4,710,780 | 12/1987 | Saito et al. | 347/55 |
| 4,751,531 | 6/1988 | Saito et al. | 347/55 |
| 4,751,532 | 6/1988 | Fujimara et al. | 347/55 |
| 4,752,782 | 6/1988 | Saito et al. | 347/55 |
| 4,752,783 | 6/1988 | Saito et al. | 347/55 |
| 4,752,784 | 6/1988 | Saito et al. | 347/55 |
| 4,801,955 | 1/1989 | Miura et al. | 347/55 |
| 4,860,048 | 8/1989 | Itoh | 347/119 X |
| 4,903,049 | 2/1990 | Sotack | 347/55 |
| 4,943,818 | 7/1990 | Hotomi | 347/55 |
| 5,128,695 | 7/1992 | Maeda | 347/55 |
| 5,381,214 | 1/1995 | Kumon et al. | 347/55 |
| 5,426,487 | 6/1995 | Stelter et al. | 355/219 |

FOREIGN PATENT DOCUMENTS

| | | | |
|---|---|---|---|
| 0437062 | 7/1991 | European Pat. Off. | 347/55 |
| 62-267146 | 11/1987 | Japan | 347/55 |
| 3-183555 | 8/1991 | Japan | 347/8 |
| 4-142950 | 5/1992 | Japan | 347/55 |
| 5-193183 | 8/1993 | Japan | 347/55 |

OTHER PUBLICATIONS

Moore, A.D., *Electrostatics and Its Applications*, 16–19 and 184–187 (1973) (U.S.A).

White, Harry J., *Industrial Electrostatic Precipitation*, 74–89 (1963) (U.S.A.).

Cobine, James Dillion, *Gaseous Conductors*, 252–265 (1958) (U.S.A.).

Choi, D.H. and Lee, F.C., *Principles of Electrohydrodynamic Ink–Jet Printing*, IBM Report RJ 8311 (75672) (Aug. 27, 1991) (Presented at Seventh International Congress on Advance in Non–Impact Printing Technologies).

Choi, D.H., and Lee, F.C., *Continuous Gray–scale Printing with the Electrohydromynamic Ink–Jet Principle*, IBM Report RJ 8913 (80000) (Aug. 10, 1992) (Presented at Eighth International Congress on Advances in Non–Impact Printing Technologies).

(List continued on next page.)

*Primary Examiner*—Joseph W. Hartary

*Attorney, Agent, or Firm*—Skjerven, Morrill, MacPherson, Franklin & Friel LLP; David E. Steuber

[57] ABSTRACT

A method for electrohydrodynamic printing wherein multiple colors are printed by discharging the receiving medium by reverse-sign corona discharge, then charging the receiving medium by corona discharge, and then printing the first color. The receiving medium is then discharged, and charged a second time by corona discharge. The process is repeated for each color used in the printing. As a result, the colors are printed in their intended locations without deflection even if the intended location is a dot of previously deposited color.

44 Claims, 8 Drawing Sheets

OTHER PUBLICATIONS

Choi, D.H. and Lee, F.C., *Continuous–Tone Color Prints by the Electrohydrodynamic Ink–Jet Method* (Oct. 4, 1993) (Presented at Ninth International Congress on Advances in Non–Impact Printing Technologies).

Williams, Edgar M., *The Physics and Technology of Xerographic Processes*, 53–65 (1984) (U.S.A.).

Cloupeau, M. and Prunet–Foch, B, *Electrostatic Spraying of Liquids: Main Functioning Modes*, Journal of Electrostatics, vol. 25, at 165–184 (1990)

.

Collins, Leland F. et al., *Point–Source Corona Current Distribution in an External Field*, IEEE Transactions on Industry Applications, vol. IA–14, No. 6, at 506–509 (Nov./Dec. 1978).

Pietrowski, Kenneth W. et al., *The Dynamics of Corona Charging an Active Matrix Organic Photoreceptor*, (1992) (Presented at Eighth International Congress on Advances in Non–Impact Printing Technologies).

Choi, Dong Ho et al., *Continuous–Tone Color Prints by the Electrohydrodynamic Ink–Jet Method*, 298–301, (1993), The 9th International Congress on Advances in Non–impact Printing Technologies/Japan Hardcopy '93.

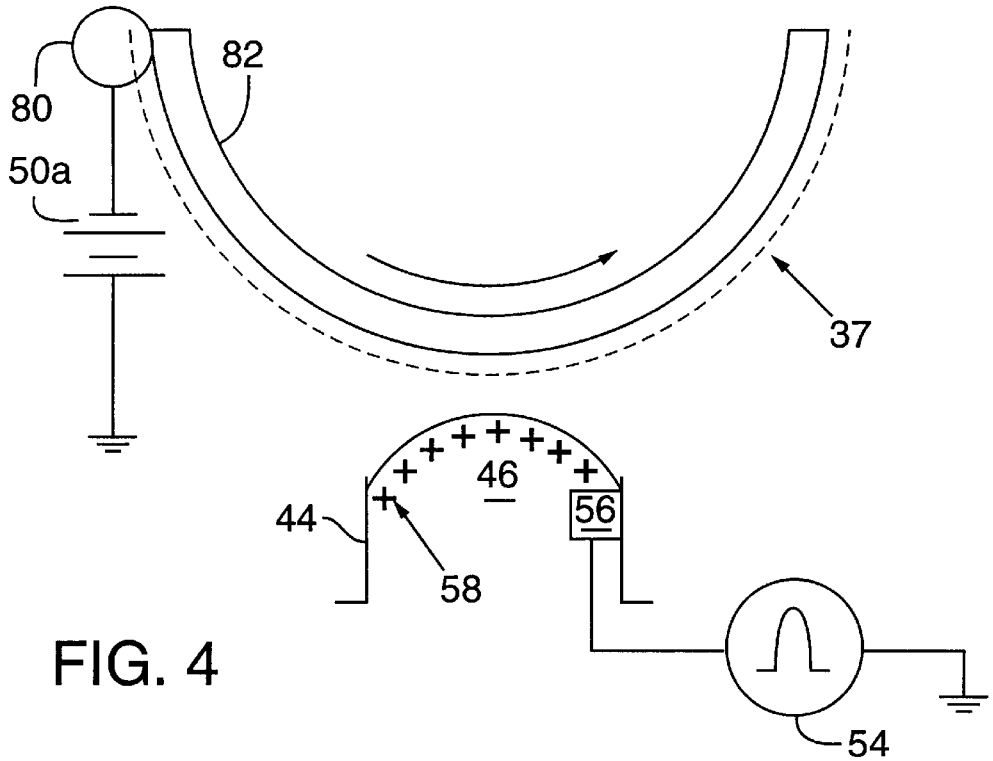
FIG. 4
FIG. 5A
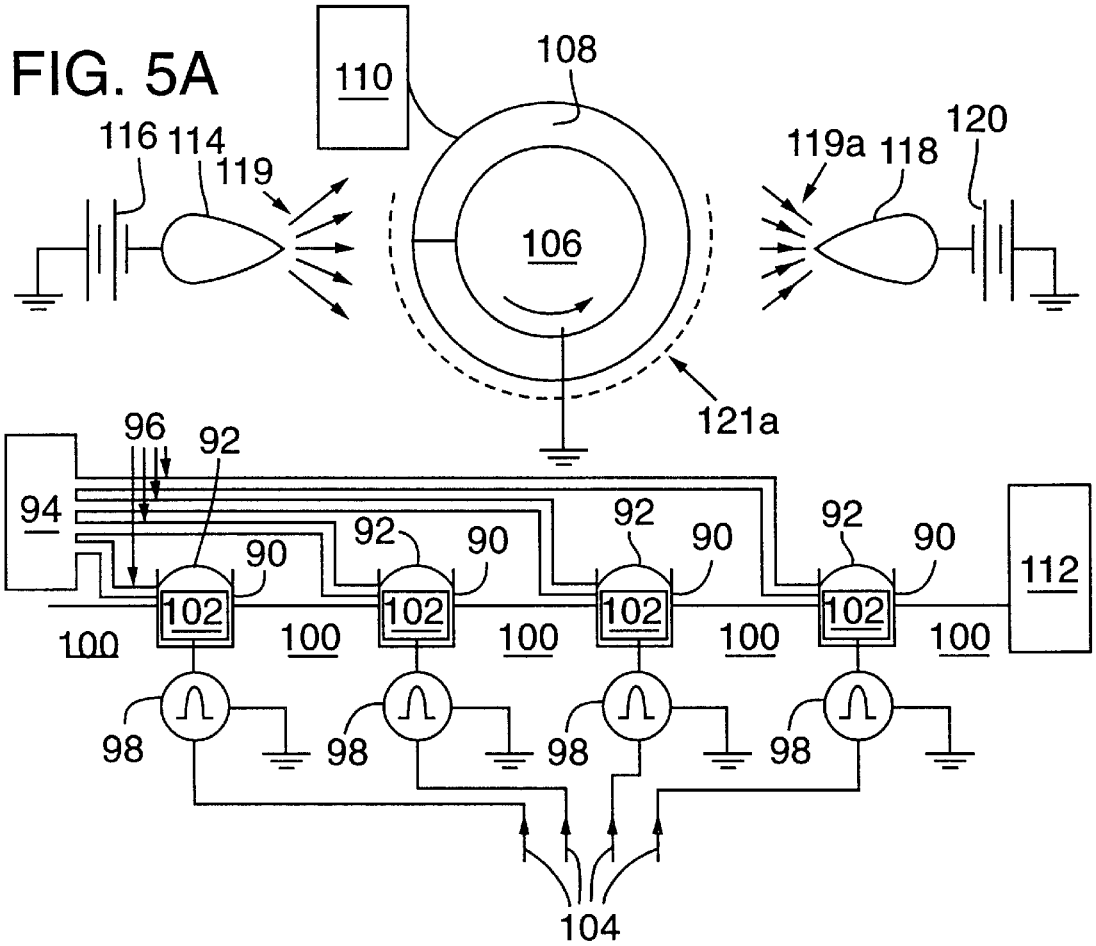

ELECTROHYDRODYNAMIC INK JET PRINTER AND PRINTING METHOD

This application is a continuation of application Ser. No. 08/261,543, filed Jun. 17, 1994, now abandoned.

FIELD OF THE INVENTION

This invention relates to an electrohydrodynamic ink jet printer, and to a method for printing on either insulating or conductive materials or for printing multiple colors using such a printer.

BACKGROUND OF THE INVENTION

Ink jet printers offer several advantages over other types of printers such as dye diffusion printers or laser printers. Dye diffusion printers, which use a printing head containing an array of heating elements, provide high-quality images by using "dot-intensity modulation" to vary the "intensity", or darkness, of individual ink "dots" or pixels. However, dye diffusion printers require relatively expensive equipment and supplies and have a slow printing rate (about three minutes per page). Laser printers use an electrophotographic process to provide medium to high-quality images, and some laser printers are now capable of using "dot-size modulation" to vary the size of the individual ink dots. However, laser printers use a complex multi-step printing process which includes charging a photoconductive drum, scanning a laser to discharge selected portions of the drum, transferring toner from the toner station onto the charged portion of the drum, transferring toner from the drum onto the paper, and fusing the toner onto the paper. The complexity of the laser printing process results in higher costs, reduced reliability, and greater maintenance problems.

Ink jet printers, in addition to being less expensive to purchase and to operate than dye diffusion or laser printers, print much faster than dye diffusion printers. Two types of drop-on-demand ink jet printers have achieved commercial success: thermal and piezoelectric. Both types transfer liquid ink from a reservoir onto paper by applying pressure to the reservoir. In thermal ink jet printers, a heating element forms a bubble of vaporized liquid ink, thereby creating a positive vapor pressure within the reservoir. In piezoelectric ink jet printers, a piezoelectric element applies mechanical pressure to the reservoir. Both of these processes are nonlinear in that, when the reservoir pressure is below a certain threshold, they produce no "dot" (they do not print) and when the reservoir pressure is above that threshold, they produce a dot of a constant size (they do not offer dot-size modulation). Since these printers do not vary the size of individual dots, they generate relatively low-quality images. In addition, spatial variations in the electrical charge on the paper or other receiving medium combined with non-uniform charging of ink drops as the ink drops detach from the nozzle may result in uncontrolled mispositioning of the ink dots on the paper caused by electrostatic forces acting on the ink as it approaches the paper.

A third type of ink jet printer, using a process referred to herein as an electrohydrodynamic process, has been developed with limited success. FIGS. 1*a* through 1*d* illustrate a typical prior art electrohydrodynamic printer (not drawn to scale). In FIG. 1*a,* one surface of a sheet of paper 10 rests against a platen 12. The opposite surface of the paper faces one or more nozzles 14 containing electrically conductive ink 16. The platen 12 and the nozzle 14 are electrically connected to a pulsed voltage power supply 18 which creates a voltage pulse (e.g., between 700 Volts and 1,500 Volts) between them. In effect, the voltage is applied between the paper 10 and the nozzle 14, since the electrically conductive paper 10 contacts the platen 12. The voltage pulse creates a distribution of electrical charge 20 on the ink, a distribution of electrical charge of the opposite polarity 22 on the paper, and an electric field in the space between the nozzle 14 and the paper 10. When the voltage pulse exceeds a certain threshold voltage, the electric field causes a jet 24 of ink to flow from the nozzle 14 onto the paper 10 (FIG. 1*b*). (A "jet" of ink can be either a continuous stream of ink or a sequence of discrete drops of ink.)

This electrohydrodynamic mechanism is a linear process: to a first approximation, the amount of ink transferred has a linear relationship to both the amplitude and the duration of the voltage pulse. In theory, electrohydrodynamic ink jet printers offer the capability to modulate the size of individual dots or pixels and therefore to produce high-quality images comparable to those generated by expensive dye diffusion printers. In practice, however, electrohydrodynamic ink jet printers have not been capable of printing a single color onto insulating materials such as transparencies or thick paper, or of printing multiple colors onto any type of surface.

FIG. 1*c* illustrates the difficulty that prior art electrohydrodynamic ink jet printers have in printing on an electrical insulator 10 such as thick paper or a transparency. When a first dot of ink 26 is jetted onto an electrical insulator, the first dot of ink 26 retains its positive charge 28. When the printer attempts to place a second dot precisely with respect to the first dot (e.g., near the first dot in a one-color process or on top of the first dot in a multiple-color process), the positive charge 28 on the first dot 26 repels the positively charged jet 29 of ink, causing it to be deflected from its intended location. The resulting erroneous deflection is known as improper "registration".

FIG. 1*d* illustrates the difficulty that prior art electrohydrodynamic ink jet printers have in printing multiple-color images on an electrically conductive surface such as thin paper. To print color images, the printer must deposit separate layers of ink, e.g., cyan, magenta, yellow, and black ink. The prior art printers deposit the first color (e.g., cyan) with good accuracy and control because the surface of the blank paper 10 has a uniform density of electrical charge. Under these circumstances, the jet of ink travels along a straight line as in FIG. 1*b*. However, these printers develop "registration" problems (they lose accuracy and control) when they deposit dots of a second color (e.g., magenta) after the cyan dots because the electrical charge density on the surface of the paper is no longer uniform: the unprinted portions of the paper have a lower charge density than the cyan dots. In each cyan dot 30, the applied voltage induces a net polarization, creating an electric dipole moment 32 arranged so the charge on the surface of the dot has the same polarity as the charge on the surface of the paper; both attract the magenta ink. But the surface of the cyan dot 30 has a higher charge density than the unprinted portions of the paper because the ink has a higher dielectric constant. For that reason, the cyan dot 30 tends to attract the magenta ink more strongly than the unprinted paper itself. Under these circumstances, the jet 34 of ink is deflected from its intended location, and the printer develops serious registration problems. The third and fourth colors are even more difficult to control than the second, for similar reasons.

These registration problems with the prior art printers are more serious when the paper or other receiving medium is an insulator, because the spatial variation in electrical charge on the surface of an insulator can be much greater and cannot be easily controlled. Spatial charge nonuniformities persist far longer with prior art printers than with the present invention, since there is no "discharge" or equalization mechanism as described below in accordance with the present invention.

SUMMARY OF THE INVENTION

An improved electrohydrodynamic ink jet printer is disclosed which uses a novel method of creating an electric field between the ink and the paper or other material to be printed. This simple, inexpensive ink jet printer is capable of generating images with good drop-on-drop registration on either electrically conductive or insulating surfaces. This improved ink jet printer is further capable of generating high-quality images by using dot-size modulation, and overcomes many of the prior art limitations.

An improved ink jet printer in accordance with the present invention is able to control the spatial charge distribution on the paper or other receiving medium so that the ink jet is not mispositioned on the receiving medium by laterally unbalanced electrostatic forces acting on the ink or other printing fluid as it approaches the receiving medium. This is accomplished by the "charging" and "discharging" methods described below, with the result that the charge distribution on the receiving medium and on the previously deposited dots of printing fluid is highly uniform in the region which is to be printed.

In one embodiment of the present invention, a corona discharge electrode "charges", or deposits a uniform electrical charge of a first polarity (a process referred to herein as "corona discharge") on the surface of a conductive "receiving medium" (thin paper or other conductive material to be printed) prior to printing. A pulsed voltage power supply then applies a charge of the opposite polarity to the nozzle holding the conductive printing fluid by creating a voltage pulse between the nozzle and ground, thereby causing a jet of printing fluid to flow from the nozzle onto the receiving medium. (As discussed below, the output of the pulsed voltage power supply may have any of a number of different waveforms and amplitudes.)

In a second embodiment, an improved ink jet printer is able to print on insulating materials such as transparencies or thick paper by first "discharging" the insulating receiving medium to remove any excess charge on the surface of the receiving medium before printing. The receiving medium is discharged by reversing the voltage applied to the corona discharge electrode (a process referred to herein as "reverse-sign corona discharge"). The polarity of the voltage applied to the corona discharge electrode is then reversed (returned to the first polarity), and the receiving medium is "charged" by corona discharge and then printed as described above.

In a third embodiment, an improved ink jet printer is able to print multiple colors by discharging the receiving medium by reverse-sign corona discharge, then charging the receiving medium by corona discharge, and then printing the first color. The printer then discharges the receiving medium by reverse-sign corona discharge (an optional step, as described below), and then charges the receiving medium a second time by corona discharge. The density of electrical charge on the receiving medium is then again substantially uniform. As a result, when the printer deposits the second color, the jet of printing fluid is deposited on its intended location without being deflected as in the prior art, even if the intended location is a dot of the previously deposited printing fluid. The printer repeats this process (optional discharge, charge, deposit the next color) for each color used in the printing process.

As used in the present invention, corona discharge is a "saturation process." That is, the corona discharge electrode continues to deposit electrical charges onto a portion of the surface of the receiving medium until the local surface voltage in that portion of the surface reaches a saturation value, then ceases to deposit charge onto that portion of the surface. The corona discharge electrode deposits whatever charge is necessary to create a spatially uniform density of electrical charge over the surface of the receiving medium, regardless of whether the receiving medium is a conductor or an insulator, and regardless of whether the receiving medium contains any previously deposited dots of printing fluid or other sources of electrical charge. As a result, an ink jet printer in accordance with this invention can print with excellent accuracy, control, and registration, even on insulating materials or in multiple-color processes.

For applications where the electrical charge must be uniformly deposited over a relatively large surface, a bare corona needle or wire would deposit an electrical charge having both spatial and temporal nonuniformities. For positive polarity corona discharge, this problem can be solved by using an auxiliary electrode partially surrounding the corona needle or wire to control the electrostatic field distribution. A variety of such devices, called "corotrons", are currently available, and result in electrical charge uniformity when used with positive polarity coronas. Negative polarity corona discharge produces even more severe electrical charge nonuniformities, which are not satisfactorily prevented by using a corotron. To achieve electrical charge uniformity with a negative polarity corona discharge, it is necessary to use a device known as a "scorotron". A scorotron consists of a series of corona wires facing a screen of larger diameter wires interposed in front of the receiving medium. The presence of the screen, biased to a potential close to that desired on the surface of the receiving medium, has a regulating effect analogous to the control grid of a vacuum tube triode, creating a uniform charge distribution on the surface of the receiving medium even with negative polarity corona discharges. (For a more complete discussion, see Williams, Edgar M., *The Physics and Technology of Xerographic Processes,* 53–65 (1984).

A corotron or scorotron (or both of them in the case of a printer including a reverse-sign corona discharge) may be used to generate a uniform charge distribution (and consequently, a uniform surface voltage distribution) on the receiving medium. All references herein to a "corona discharge electrode" or to a device performing a similar function are defined to mean a corotron or scorotron (whichever is appropriate for the particular application).

Although the corotron and scorotron are currently used in electrophotographic printers to charge both the photoconductive drum and the printing medium (two distinct steps), the use of a corona discharge device in electrohydrodynamic printing is a novel concept which addresses two key issues of printing applications: continuous tone generation and media independence (to enable printing on a wide variety of printing media).

DESCRIPTION OF THE DRAWINGS

FIG. 4 illustrates an embodiment of the present invention which includes a tribocharger.

FIGS. 5*a,* 5*b* and 5*c* illustrate several embodiments of the present invention. In FIG. 5*a,* a single-color printer with an array of nozzles prints onto a receiving medium mounted on a cylindrical drum.

FIG. 6*a* shows a corona discharge needle used with a cylindrical platen.

DETAILED DESCRIPTION

Figure 1A:
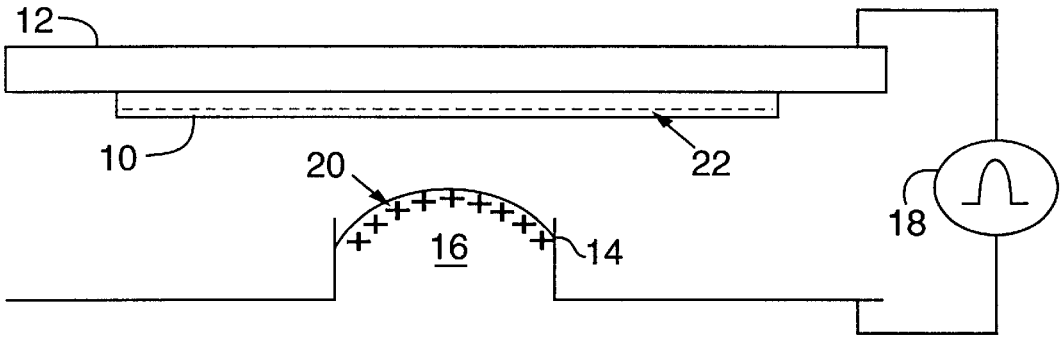
FIG. 1A (Prior Art)
FIGS. 1*a,* 1*b,* 1*c* and 1*d* illustrate a prior art electrohydrodynamic printer.
Figure 1B:
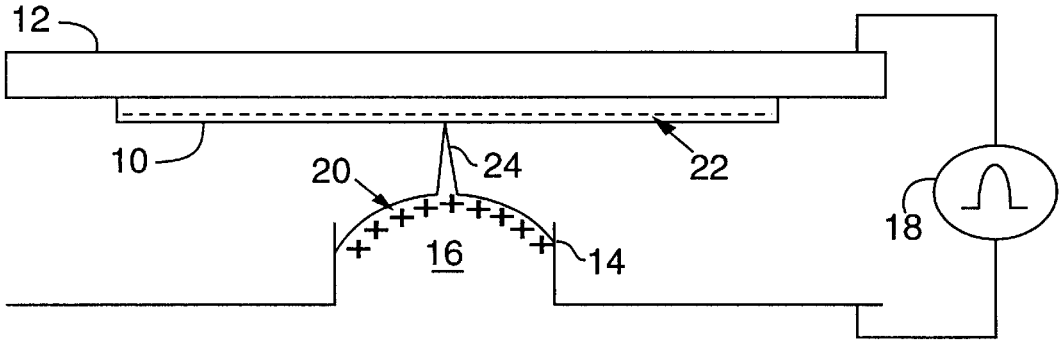
FIG. 1B (Prior Art)
Figure 1C:
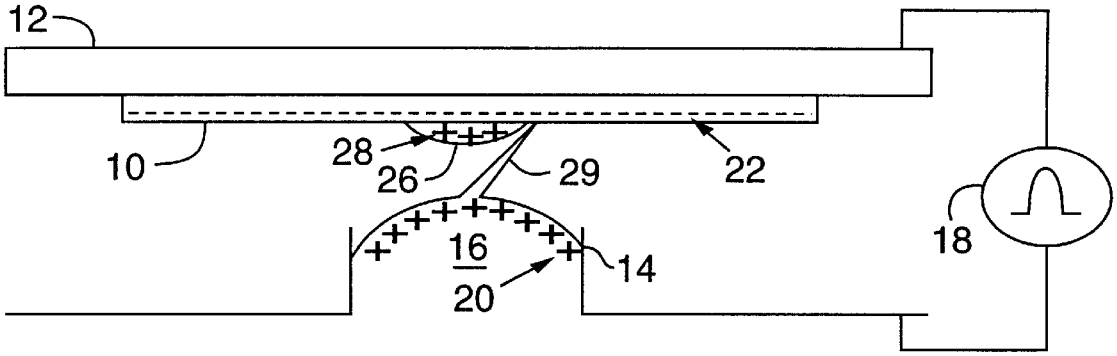
FIG. 1C (Prior Art)
Figure 1D:
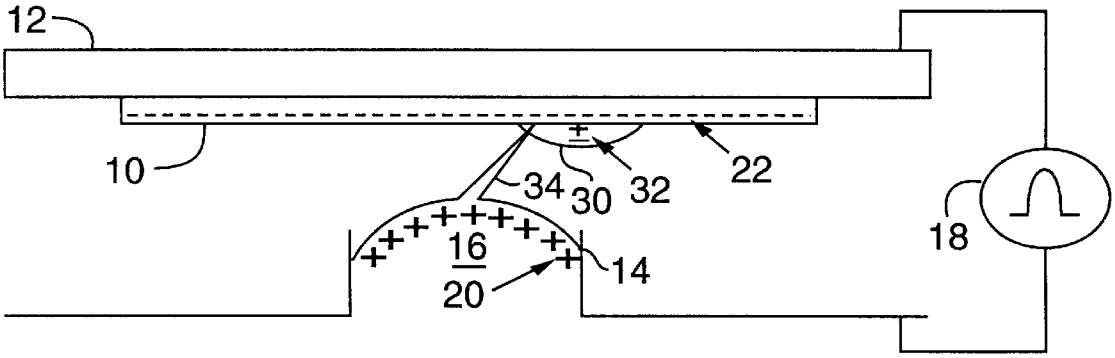
FIG. 1D (Prior Art)
Figure 2A:
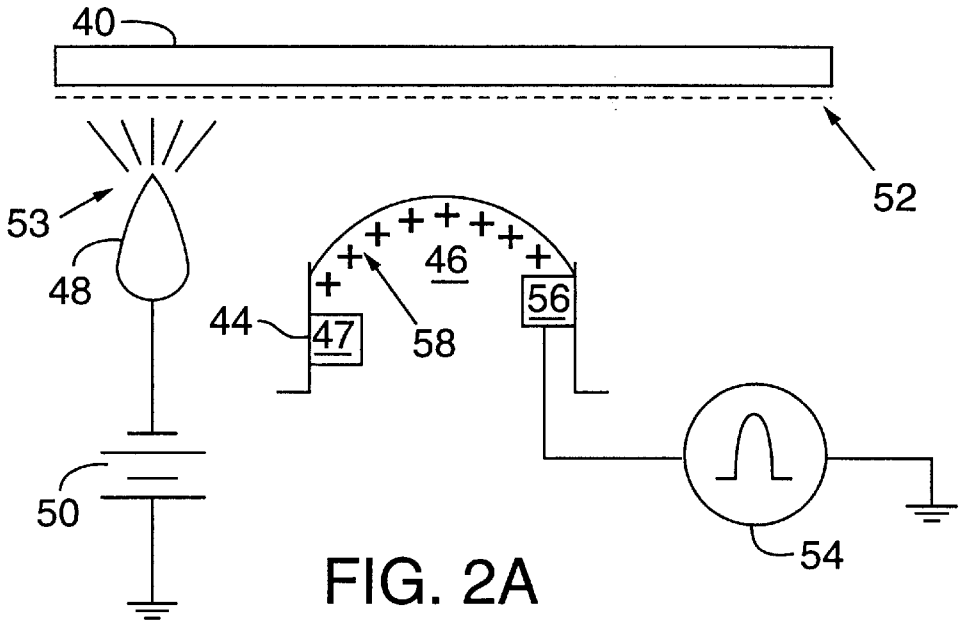
FIGS. 2*a,* 2*b,* 2*c* and 2*d* illustrate an embodiment of the present invention which is used to print on either an insulating or conductive material.
Figure 2B:
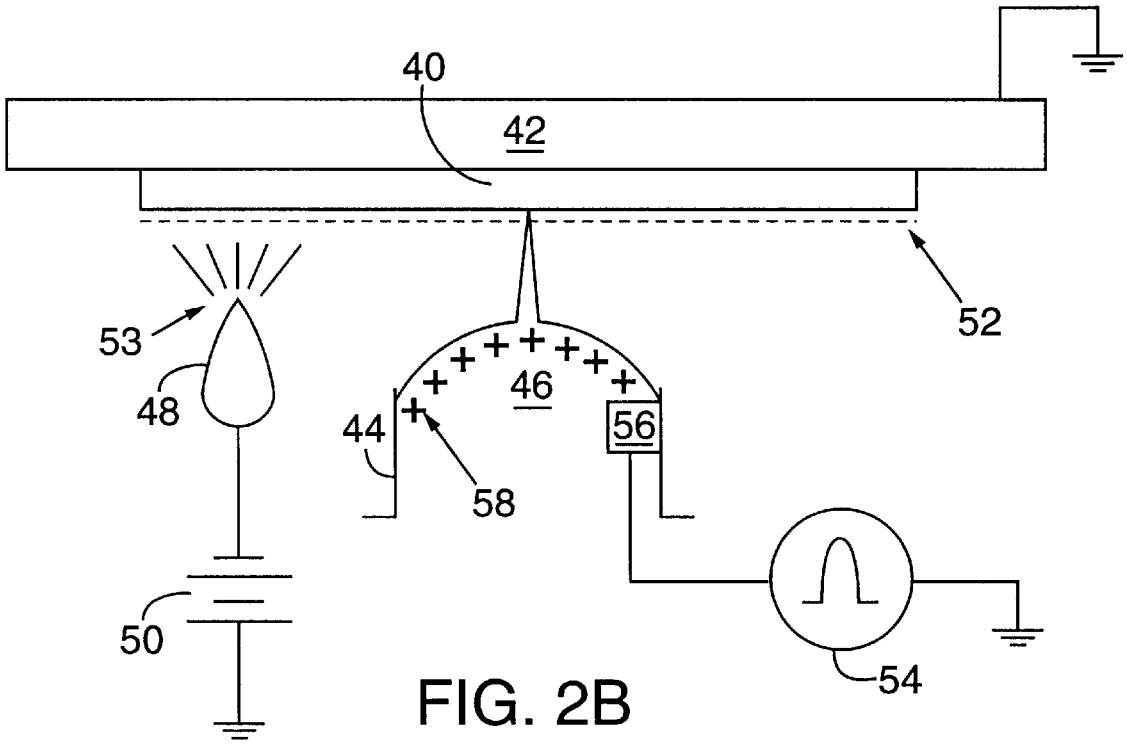

FIGS. 2*a* through 2*d* illustrate an embodiment of the invention which is used to print either on insulating materials such as transparencies or thick paper, or on conductive materials. (In order to show particular features of various embodiments of the invention more clearly, FIGS. 1–6 are not drawn to scale.) A support (typically, either a flat platen 42 as shown in FIG. 2*b,* or a cylindrical platen) holds the paper or other receiving medium 40 to be printed. The platen 42 can be made of either an electrically insulating material such as plastic or of an electrically conductive material such as metal. One surface of the receiving medium 40 faces a nozzle 44 which holds the ink or other conductive printing fluid 46. (FIG. 2*a* shows a resistive heater 47 or other heating device for applying heat to hot-melt ink to raise its temperature above the melting point.)

First, the receiving medium 40 is discharged by reverse-sign corona discharge, as described above, to remove any excess charge on the surface of the receiving medium. This is done by reversing the voltage applied to the corona discharge electrode 48 by the power supply 50. The corona discharge electrode 48 is typically a needle or wire, although other configurations are possible. The polarity of the voltage applied to the corona discharge electrode 48 is then reversed (returned to the first polarity), and the corona discharge electrode 48 is moved relative to the receiving medium 40, in order to "charge" or deposit a uniform electrical charge 52 of a first polarity on the surface of the receiving medium 40. FIG. 2*a* shows a corona discharge electrode 48 emitting ions 53 which create the uniform electrical charge 52 on the receiving medium 40. A pulsed voltage power supply 54 then applies a voltage pulse to an electrode 56 in contact with the conductive printing fluid 46 (or to the nozzle 44, if a conductive nozzle is used), creating an electrical charge 58 of the opposite polarity on the surface of the printing fluid. The electrode 56 can be positioned either near the opening of the nozzle 44, as shown in FIG. 2*b,* or below the surface of the printing fluid 46 (FIG. 3*b*). The nozzle 44 can have various configurations. It can be either a protruding spout of various shapes or sizes, or merely an opening (for example, a rectangular slit or a round hole) in a surface. Typically, the nozzle 44 is located about 0.5–1.0 mm from the platen 42. As described above, the electrical charges of opposite polarity on the surface of the printing fluid and the surface of the receiving medium establish an electrical field between the printing fluid and the receiving medium. The electric field causes a jet 60 of printing fluid to flow from the nozzle 44 onto the receiving medium 40 (FIG. 2*b*).

Figure 2C:
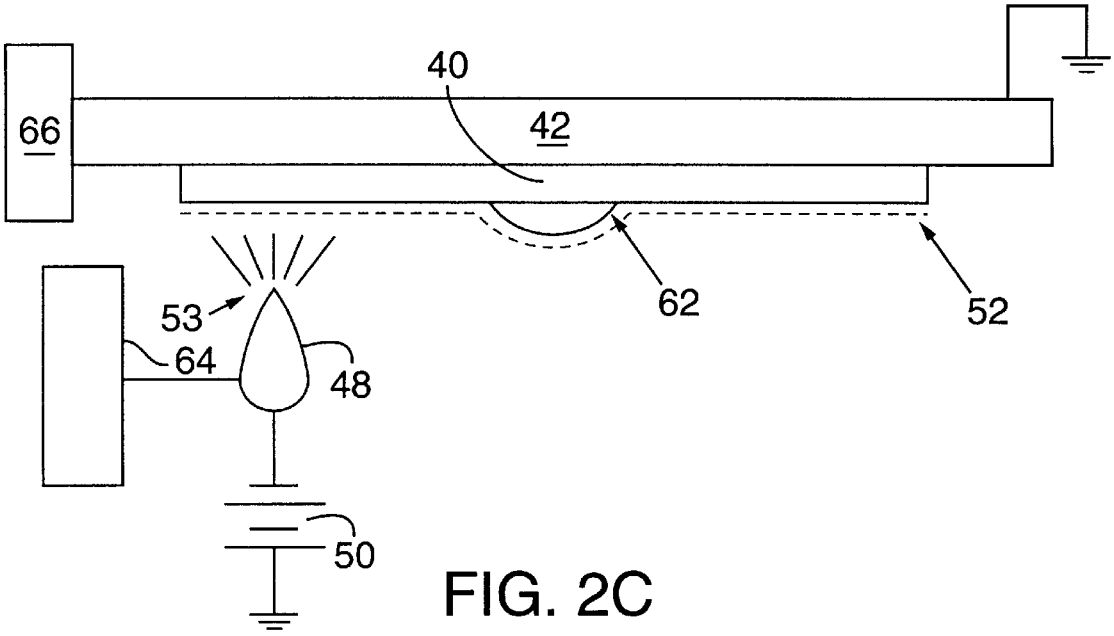
Figure 2D:
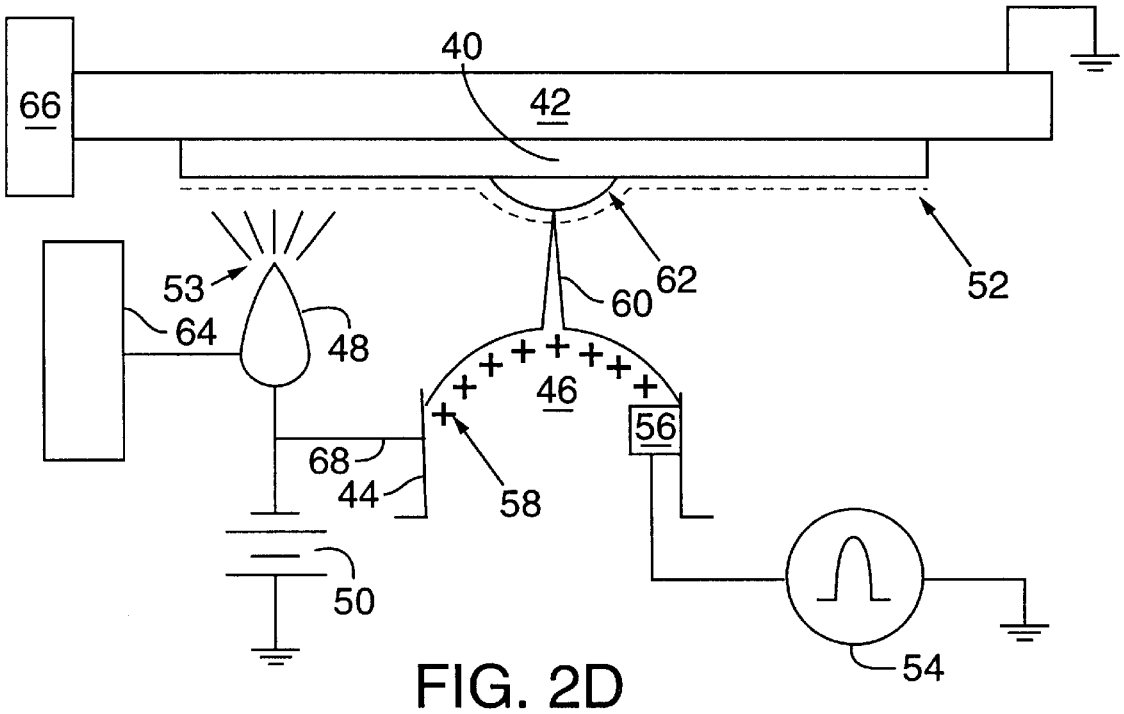

In FIG. 2*c,* the corona discharge electrode 48 continues to deposit a uniform density of electrical charge 52 on both the surface of the receiving medium 40 and the surface of the first dot 62 of printing fluid that was just deposited. As shown in FIG. 2*d,* when a voltage of the appropriate magnitude and polarity is applied to the printing fluid, a jet 60 of printing fluid can deposit a second dot of ink directly onto the previously deposited dot 62, without being deflected from its intended location as in the prior art. (Compare FIG. 1*c,* where the positive charge 28 in the dot of printing fluid 26 on the surface of the receiving medium 10 deflects the jet 29 of printing fluid away from its intended location.) The embodiment shown in FIGS. 2*a* through 2*d,* in contrast with the prior art, makes it possible to print either a single color or a multiple-color process onto an insulating material such as a transparency or thick paper without losing accuracy or developing improper registration.

In FIG. 2*a,* the polarities are arranged so that a positive charge 58 exists on the surface of the printing fluid 46 and a negative charge 52 exists on the surface of the paper or other receiving medium 40. However, it is possible to reverse the polarities so that a negative charge exists on the surface of the printing fluid 46 and a positive charge exists on the surface of the receiving medium 40.

Different types of ink may be used, including liquid ink, hot-melt ink, and ink consisting of pigments in a volatile fluid. Alternatively, it should be possible to use other substances such as glue, molten solder, biological fluids or materials in suspension such as blood or plasma, or fine particulate matter such as toner particles for a printing fluid 46, provided that such printing fluids possess certain properties as described below.

Hot-melt ink is a solid at room temperature and a liquid above its melting point, which is usually near 80° centigrade. When printing with hot-melt ink, it is necessary to use a heater to supply the ink at a temperature above its melting point. It is optional to use a second heater to heat the receiving medium so the ink will spread before it solidifies.

When printing with ink which consists of pigments in a volatile fluid, the volatile fluid serves only to help transport the pigments from the nozzle to the receiving medium; it evaporates soon after the ink reaches the receiving medium. It is then necessary to apply a means for fusing the pigments onto the receiving medium, for example, a heated roller which applies mechanical pressure onto the material and the receiving medium.

The invention can also be used to join two objects by using the printing fluid as an adhesive. For example, the invention may prove useful in applying an adhesive selectively to integrated circuits to bond them to electronic packaging.

It should be possible to use fine particulate matter as a printing fluid in an ink jet printer, since it exhibits fluid-like properties, particularly when subjected to agitation from acoustic sources.

Figure 3A:
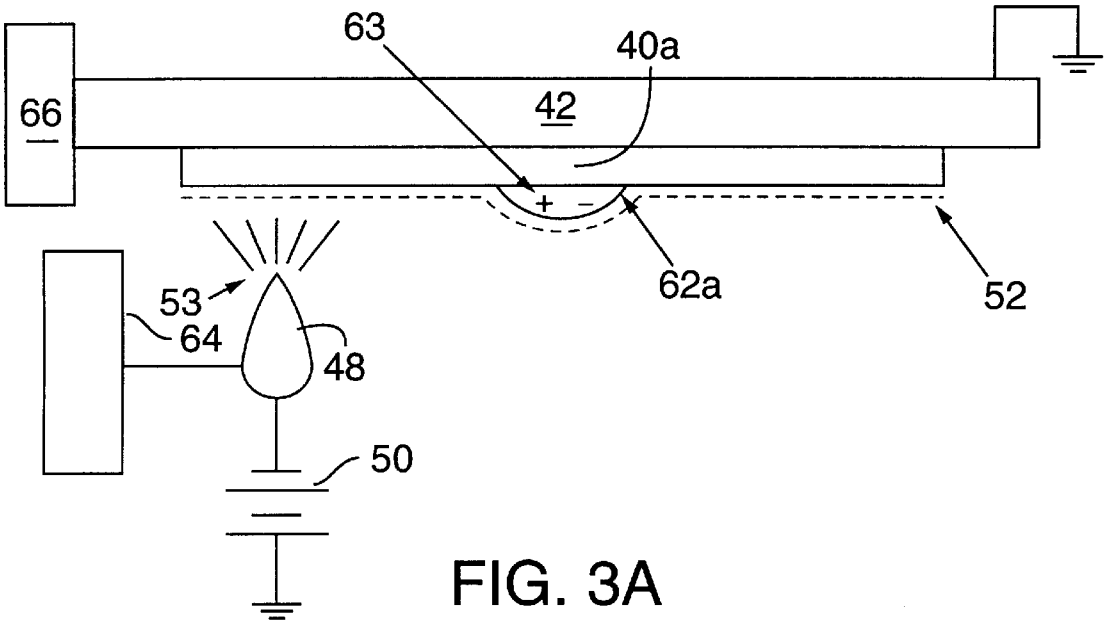
FIGS. 3*a* and 3*b* illustrate an embodiment of the present invention which is used to print multiple colors.
Figure 3B:
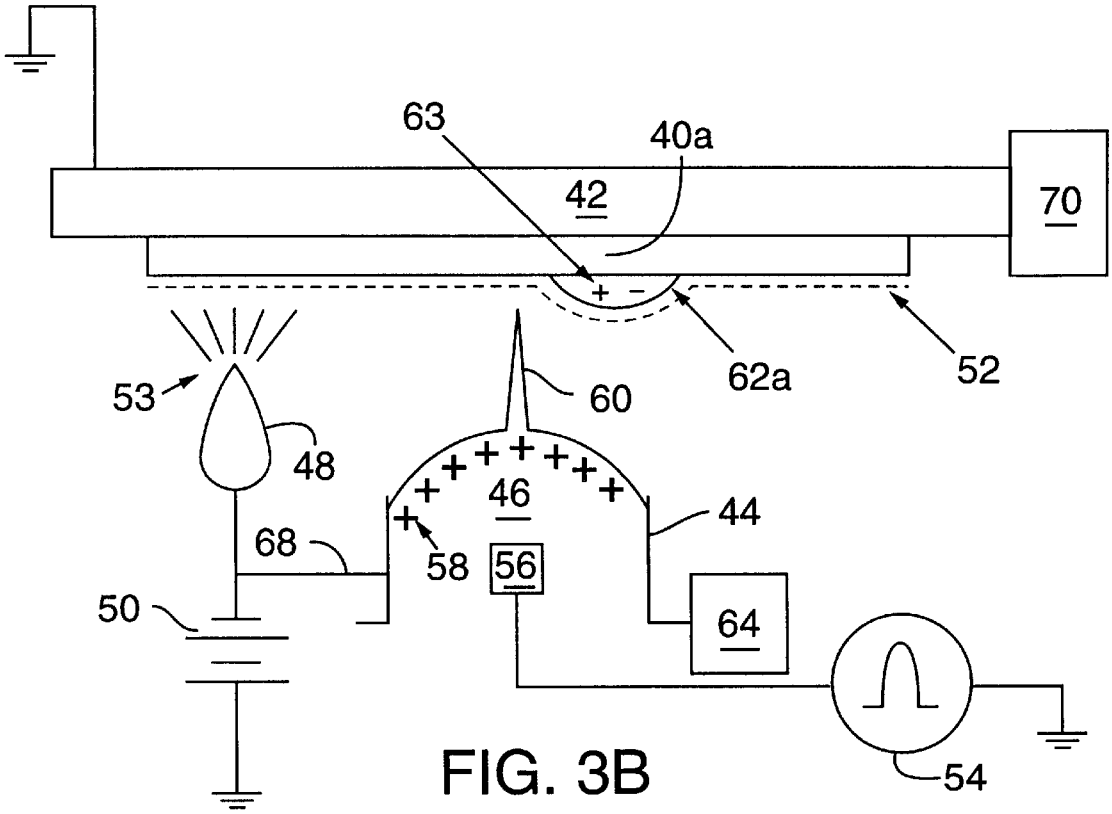

FIGS. 3*a* and 3*b* illustrate how this embodiment of the invention is able to print multiple colors on a receiving medium 40. The corona discharge electrode 48 deposits electrical charges 52 uniformly over both the surface of the receiving medium 40*a* and the surface of a previously deposited dot 62*a*. As shown in FIG. 3*b,* the jet 60 of printing fluid deposits a second dot of ink adjacent to the previously deposited dot 62*a,* without being deflected from its intended location by the nonuniform electrical charge due to the electric dipole moment 63 as in the prior art (FIG. 1*d*).

In FIG. 2*c,* a first driving means 64, such as a servomechanism powered by an electric motor, is used to provide relative movement between the corona discharge electrode 48 and the receiving medium 40 as described below, so that the corona discharge electrode can deposit a uniform density of electrical charge over the entire surface of the receiving medium 40. FIG. 2*d* shows the use of a second driving means 66, such as a similar servomechanism, to provide relative movement between the nozzle 44 and the receiving medium 40. A commercial printer might contain either one or both of these driving means, or a single driving means performing both functions.

In FIG. 2*d*, a brace 68 physically (but not electrically) connects the corona discharge electrode 48 and the nozzle 44. With this brace 68 in place, the driving means 64 for moving the corona discharge electrode 48 relative to the receiving medium 40 also moves the nozzle 44 relative to the receiving medium 40 at the same time. FIG. 3*b* shows a first driving means 64 for causing both the corona discharge electrode 48 and the nozzle 44 to move relative to the receiving medium 40*a*, and a second driving means 70 for causing the receiving medium 40*a* to move relative to the nozzle 44. Either of these driving means for changing the relative positions of the nozzle 44 and the receiving medium 40*a* are useful for directing dots of ink onto a wide area.

FIG. 4 illustrates another embodiment of the invention which uses a tribocharger 80, rather than a corona discharge electrode, to charge and discharge the recording medium. "Tribocharging" means charging by friction. Thus, the receiving medium 82 is charged by placing it into sliding or rolling frictional contact with the tribocharger 80. An electrical charge of a first polarity is induced on the tribocharger 80 by the power supply 50*a*. Alternatively, an electrical charge may be induced on the tribocharger 80 by shining light on it to excite carriers, by using other solid state techniques, or by using a corona discharge electrode. A second electrical charge of the opposite polarity is applied to the ink or other printing fluid 46 by an electrode 56 connected to a pulsed voltage power supply 54.

Figure 5B:
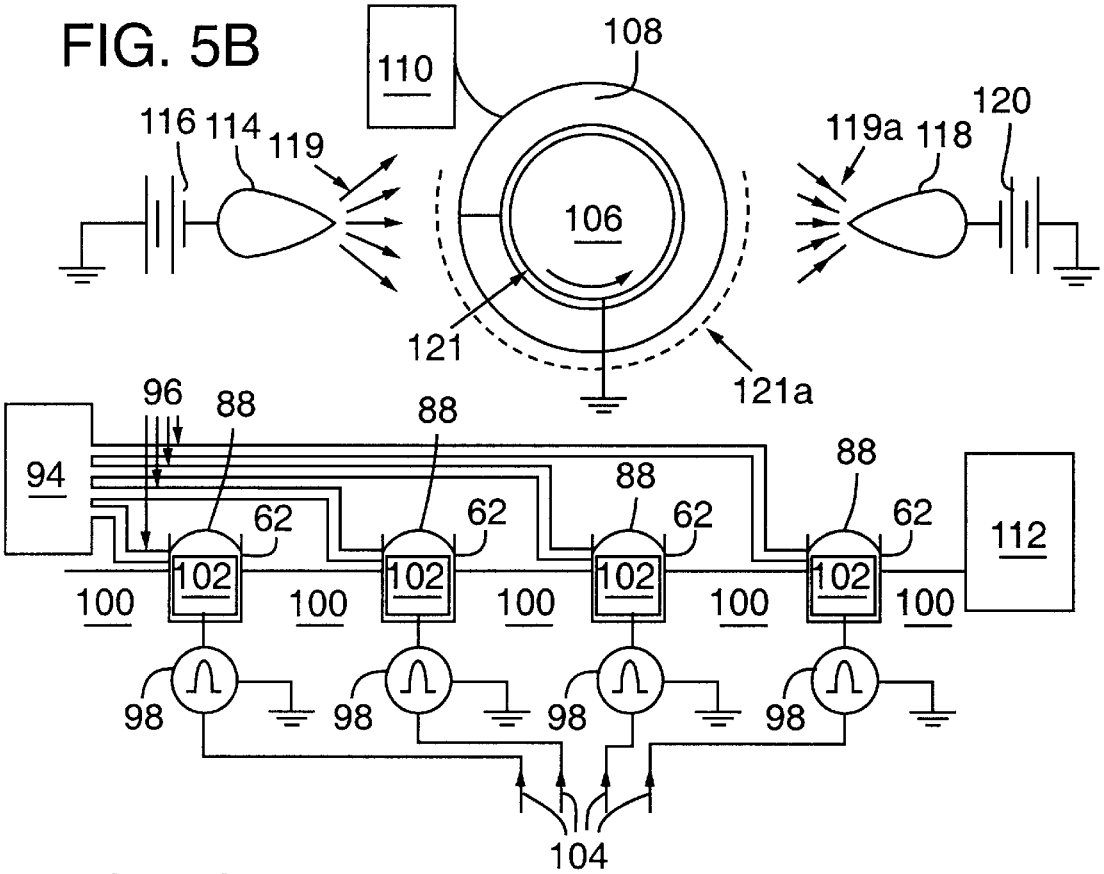
In FIG. 5*b,* a single-color printer with an array of nozzles prints onto a receiving medium separated from the drum by a layer of insulating material.
Figure 5C:
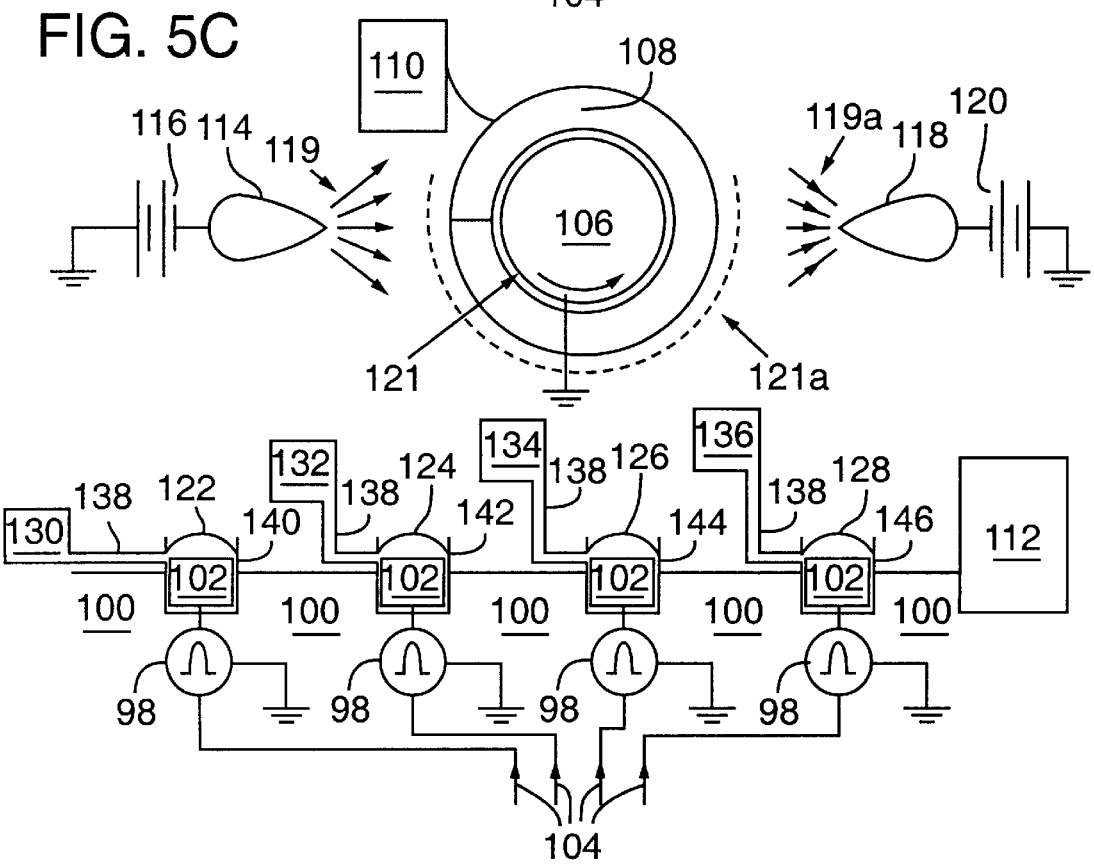
FIG. 5*c* illustrates a multiple-color printer.

FIG. 5*a* illustrates another embodiment of the invention which is used in single-color printing processes. The single nozzle is replaced by an array of nozzles 90 containing ink or other printing fluid 92. Although only a few nozzles 90 are illustrated, a large number of nozzles may be used. (FIGS. 5*a*–5*c* show a front view of the printer, but a side view of the nozzle array 90, so that the details of the nozzle array 90 may be illustrated more clearly. Nozzle array 90 is located near the receiving medium, and may be oriented in a variety of directions according to the particular application.) A reservoir 94 supplies the printing fluid 92 to the nozzles 90 through flow channels 96. Each nozzle 90 has a separate pulsed voltage power supply 98 for applying a voltage to the printing fluid 92 in each nozzle 90 independently of the printing fluid in each other nozzle. Insulators 100 insulate the printing fluid 92 in each nozzle 90 from the printing fluid in each other nozzle. Each pulsed voltage power supply 98 is connected to an individually addressable electrode 102, with each electrode having its own control line 104. Insulators 100 are, for example, nozzle plates made from an electrically insulating material such as plastic.

In theory, the printing fluid 92 in each nozzle 90 is electrically connected to the printing fluid in each other nozzle because the printing fluid itself is electrically conductive. However, the flow channels 96 leading to and from the reservoir 94 are sufficiently long that currents can flow from one nozzle 90 to another nozzle only in a time period which is very long compared to the typical time period required for the printing signals. In practice, therefore, the electrical connection of one nozzle 90 to another nozzle through the printing fluid itself can be ignored.

In FIG. 5*a*, a cylindrical platen 106 supports the paper or other receiving medium 108. The platen 106 can be made from either an electrically insulating material such as plastic or an electrically conductive material such as metal. An electric motor or other rotating means 110 rotates the platen. A driving means 112 causes the nozzle array 90 to move parallel to the longitudinal axis of the platen 106, providing relative movement between the nozzle array 90 and the receiving medium 108.

FIG. 5*a* shows both a corona discharge electrode 114 with a power supply 116 for charging the receiving medium 108, and a reverse-sign corona discharge electrode 118 with a power supply 120 having a polarity opposite that of the corona discharge electrode 114 for discharging the receiving medium. The corona discharge electrode 114 emits ions 119 to charge the receiving medium 108, and the reverse-sign corona discharge electrode 118 discharges the receiving medium 108 by emitting ions 119*a* of the opposite polarity. Alternatively, a tribocharger could be used to either charge or discharge the receiving medium.

FIG. 5*b* illustrates a layer of mylar or other electrically insulating material 121 interposed between the platen 106 and the receiving medium 108. When the platen 106 is made of electrically conductive material, the mylar helps to keep the electrical charge 121*a* localized on the receiving medium 108 rather than allowing it to migrate into the platen 106.

FIG. 5*c* illustrates another embodiment of the invention which is able to print multiple colors on either a conductive or an insulating receiving medium 108. In FIG. 5*c*, four different colors of ink or other printing fluid 122, 124, 126, 128 are used, each with its own reservoir 130, 132, 134, and 136 respectively. Flow channels 138 connect each nozzle (140, 142, 144, and 146) to one of the four reservoirs, allowing ink to flow into each nozzle. In this embodiment, each nozzle is connected to only one reservoir containing only one color of ink. It would be possible, however, to connect each nozzle to a plurality of reservoirs, each containing a different color of ink, so that each nozzle could print a plurality of colors. It would also be possible to connect multiple nozzles to each reservoir in order to increase printing speed.

In FIG. 5*c*, the reverse-sign corona discharge electrode 118 is first used to discharge the receiving medium 108. The corona discharge electrode 114 is then used to charge the receiving medium 108, and the first color is printed. Next, the reverse-sign corona discharge electrode 118 is used to discharge the receiving medium (an optional step, which is only necessary if an unusual amount of excess charge builds up on the receiving medium). The corona discharge electrode 114 is then used to charge the receiving medium 108, and the second color is printed. Since the density of electrical charge on the receiving medium is substantially uniform when the printer deposits the second color, the jet of printing fluid is deposited on its intended location without being deflected as in the prior art, whether or not the intended location is adjacent to or directly upon a dot of the previously deposited printing fluid. The printer repeats this process (optional discharge, charge, deposit the next color) for each color used in the printing process.

In printing multiple colors (or multiple jets of one color to the same location), it is advantageous to reverse the polarities of the corona discharge electrode 114 and the electrodes 102 before each successive dot is deposited. For example, in FIG. 5*c* the color cyan is first deposited using the corona discharge electrode 114 to establish a negative charge on the receiving medium 108 and using the electrodes 102 to establish a positive charge on the printing fluid. These polarities are then reversed and a second color, such as magenta, is deposited. Similarly, the polarities are again reversed before each successive color is deposited. In this manner, subsequently deposited ink drops are attracted by any residual charge which remains on previously deposited dots. This attraction takes the form of a convergent force which may in certain applications actually eliminate or reduce the need for the discharging and charging processes described herein, provided that successive ink drops are deposited with alternating polarities of charge. This method (of reversing the polarities of the corona discharge electrode 114 and the electrodes 102) is most appropriate when the subsequently deposited drops are to be positioned directly upon (rather than adjacent to) the previously deposited dots.

It is desirable to use a voltage pulse on a nozzle having a peak voltage, for example, of about 1,000 volts. However, it is advantageous to use a voltage pulse which minimizes the voltage swing on the nozzle because the nozzle turns on and off at high frequency; therefore, a lower voltage swing on the nozzle allows a simpler, less expensive pulsed voltage power supply 98 to be used. For example, rather than using a pulsed voltage power supply 98 to supply a voltage pulse having a "low level" of 0 volts and a "high level" or peak voltage of 1,000 volts (a voltage swing of 1,000 volts), it is desirable to supply a voltage pulse having a low level of 200 volts and a high level or peak voltage of 1,000 volts (a voltage swing of only 800 volts). The power supply 116 for the corona discharge electrode 114 is then adjusted as described below so that the peak voltage on the nozzle causes the printing fluid to begin jetting, while the low level voltage on the nozzle causes the printing fluid to stop jetting. It should be understood that these voltages are only exemplary, and that a wide range of voltages may be used in practicing the invention.

Stable, continuous jetting can be achieved by first choosing a printing fluid having the right combination of properties. The following table shows a working example and a useful range for typical inks which are currently available.

| Property | Range | Example | Unit |
|---|---|---|---|
| Electric resistivity | $10^6$–$10^{11}$ | $10^8$ | Ω cm |
| Dielectric constant | 2–3 | 2.6 | |
| Surface tension | 24–40 | 26 | dyne/cm |
| Viscosity | 0.4–15 | 10 | cP |
| Specific density | 0.6–1.2 | 0.77 | |

For all practical purposes, printing fluids with resistivities in the above range do not exhibit large variations in the dielectric constant, which is typically between 2 and 3. Printing fluid formulations where the dielectric constant can be increased above this range are desirable.

After selecting a printing fluid, it is necessary to establish several other interrelated parameters within suitable ranges in order to maintain steady jetting. The following table shows a working example and a useful range for such parameters when printing with hot-melt ink on paper. It is expected that other useful ranges for such parameters will be found to be appropriate for other types of printing fluids and receiving media.

| Parameter | Range | Example | Unit |
|---|---|---|---|
| Nozzle peak voltage | 700–1500 | 1000 | Volt |
| Nozzle voltage polarity | pos/neg | pos | |
| Nozzle-platen gap | 0.3–2.0 | 0.5 | mm |
| Corona point diameter | 10–200 | 10 | μm |
| Corona point-to-platen gap | 1–7 | 3 | mm |
| Corona wire diameter | 50–300 | 100 | μm |
| Corona wire-to-platen gap | 1–7 | 2 | mm |
| Corona voltage polarity | pos/neg | pos | |
| Corona electrode voltage | 3–20 | 7 | kVolt |
| Frequency | 0–4 | 1 | kHz |
| Nozzle outside diameter | 0.2–0.4 | 0.2 | mm |
| Nozzle inside diameter | 0.1–0.3 | 0.1 | mm |
| Nozzle inside length | 0.2–5.0 | 0.4 | mm |
| Hydrostatic column height | 0–80 | 44 | mm |

Although the pulsed voltage power supply 98 used in this embodiment supplied a square wave voltage pulse, it should be possible to use other wave shapes (e.g. sawtooth, sinusoidal or combinations thereof). Further, dot-size modulation is achieved, for example, by using a pulsed voltage power supply 98 which provides pulse-width -modulated voltage pulses (or, alternatively, pulse-amplitude modulated pulses). A number of different possible combinations of corona electrode voltage and nozzle peak voltage and pulse shape will be readily apparent to a person of ordinary skill in the art.

In general, it is desirable to select parameters which increase the jetting frequency (to increase printing speed) and which decrease the voltage swing applied to the nozzle (to decrease the cost of high-voltage switches and power supplies).

As different media have different electrical properties, it is desirable to use an electric field sensor whose out put controls the pulsed voltage power supply 98 for the corona discharge electrode 114 in order to produce consistent electrical fields in the nozzle-platen region.

It may be necessary to adjust the above parameters for different operating conditions. In particular, operating the printer under ambient conditions of low relative humidity may result in a "sparkover" problem. When sparkover occurs, there is an electric spark discharge between the corona discharge electrode (or the reverse-sign corona discharge electrode) and the receiving medium, instead of the normal corona discharge. Since there is no corona discharge, the printer cannot operate properly. By adjusting the above parameters (e.g., by reducing the corona point-to-platen distance and reducing the corona electrode voltage), it is possible to provide a wider operating range within which sparkover does not occur.

Figure 6A:
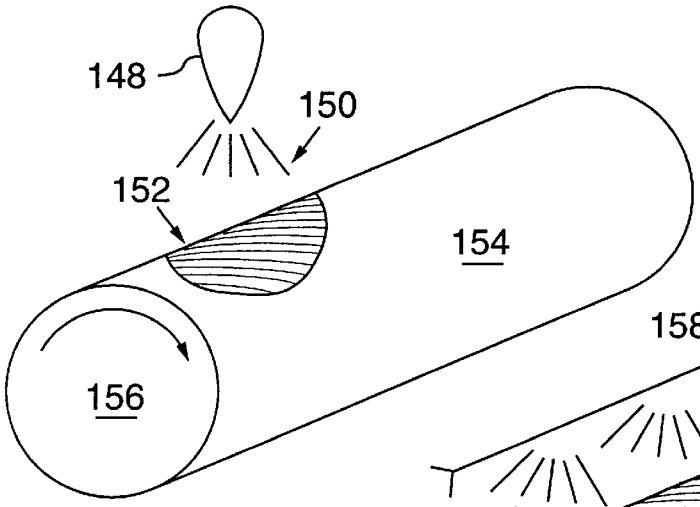
FIGS. 6*a,* 6*b,* 6*c* and 6*d* illustrate several embodiments of a corona discharge electrode.
Figure 6B:
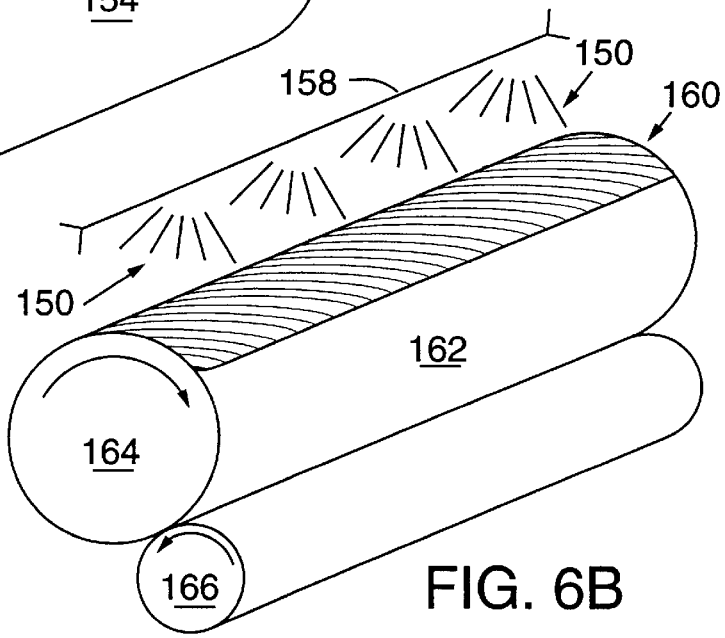
FIG. 6*b* shows a corona discharge wire used with a cylindrical platen.
Figure 6C:
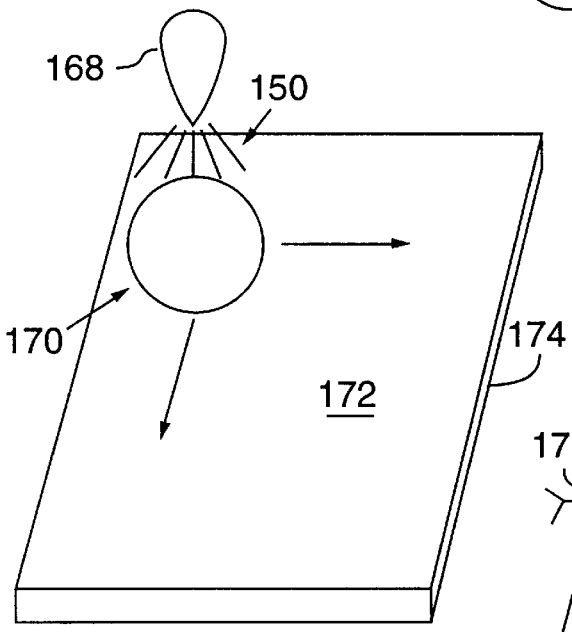
FIG. 6*c* shows a corona discharge needle used with a rectangular platen.
Figure 6D:
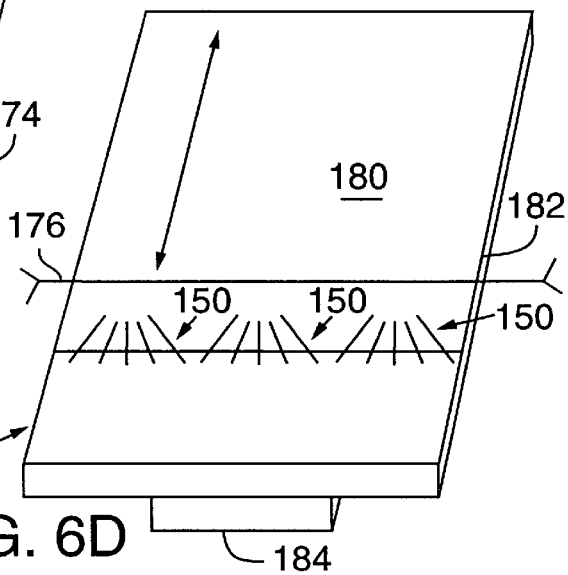
FIG. 6*d* shows a corona discharge wire used with a rectangular platen.

FIGS. 6*a* through 6*d* illustrate different embodiments of the corona discharge electrode. FIG. 6*a* shows a corona discharge needle 148 emitting ions 150 which create a charged area 152 on a paper or other receiving medium 154 supported by a cylindrical platen 156. FIG. 6*b* shows a corona discharge wire 158 emitting ions 150 which create a charged area 160 on a paper or other receiving medium 162 supported by a cylindrical platen 164. A roller 166 fuses the printing fluid (not shown) onto the receiving medium 162. This embodiment is used for printing with ink composed of pigment in a volatile liquid; after the liquid evaporates, the roller 166 fuses the pigment to the receiving medium 162. FIG. 6*c* illustrates a corona discharge needle 168 emitting ions 150 which create a charged area 170 on a paper or other receiving medium 172 supported by a rectangular platen 174. Relative movement between the corona discharge needle 168 and the receiving medium 172 allows the electrical charge over the entire surface of the receiving medium 172 to be controlled. FIG. 6*d* illustrates a corona discharge wire 176 emitting ions 150 which create a charged area 178 on a paper or other receiving medium 180 supported by a rectangular platen 182. Relative movement between the corona discharge wire 176 and the receiving medium 180 allows the electrical charge over the entire surface of the receiving medium 180 to be controlled. A resistive heater or other heating means 184 is included for heating the platen 182. The heater 184 heats the receiving medium 180 to help the printing fluid (not shown) spread before it solidifies.

The method of establishing a spatially uniform electrical charge distribution on a receiving medium according to this invention in order to accurately control ink placement has been described by reference to an ink jet printer, but should be applicable to other types of printers. For example, it should be possible to use the charging and discharging methods described above in a piezoelectric or thermal ink jet printer in order to more accurately position printing fluid particles on the receiving medium.

In specific printers, it may be advantageous to include multiple corona discharge electrodes and reverse-sign corona discharge electrodes as well as multiple print heads and nozzles to improve the performance and increase the efficiency of the printer.

It is to be understood that the above description is intended to be illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. A method for printing, comprising the steps of:

(a) depositing a uniform electrical charge of a polarity P1 onto a surface of a receiving medium;

(b) applying an electrical charge to a printing fluid in a nozzle, so that an electrical field is established between said printing fluid and said receiving medium which is sufficient to cause said printing fluid to be attracted to and deposited on said receiving medium;

(c) depositing a uniform electrical charge of a polarity P2 opposite to said polarity P1 onto said surface of said receiving medium;

(d) depositing a uniform electrical charge of said polarity P1 onto said surface of said receiving medium;

(e) applying an electrical charge to a printing fluid in said nozzle, so that an electrical field is established between said printing fluid and said receiving medium which is sufficient to cause said printing fluid to be attracted to and deposited on said receiving medium; and (f) performing steps (c), (d), and (e) at least one additional time.

2. A method as in claim 1 wherein said printing fluid is selected from the group consisting of ink, liquids, toner particles, fine particulate matter suspended in air or liquid, adhesives, molten material, and organic material.

3. A method as in claim 1 wherein step (f) comprises performing steps (c), (d), and (e) with at least one other nozzle, and with at least one other printing fluid, so that a plurality of printing fluids are deposited on said receiving medium.

4. A method as in claim 3 wherein each of said nozzles is electrically insulated from each other of said nozzles, so that a separate electrical charge can be applied to said printing fluid in each of said nozzles.

5. A method as in claim 4, further comprising the step of providing relative movement between each said nozzle and said receiving medium.

6. A method as in claim 4, further comprising the step of applying heat to said printing fluid.

7. A method as in claim 4, further comprising the step of applying heat to said receiving medium.

8. A method as in claim 4, wherein said receiving medium is selected from the group consisting of paper, transparencies, metals, ceramics, plastics, textiles, and semiconductors.

9. A method as in claim 3 wherein said printing fluid is selected from the group consisting of ink, liquids, toner particles, fine particulate matter suspended in air or liquid, adhesives, molten material, and organic material.

10. A method as in claim 1 wherein:

step (a) comprises depositing a uniform electrical charge of polarity P1 from a corona discharge electrode onto said surface of said receiving medium; and step (c) comprises depositing a uniform electrical charge of polarity P2 from said corona discharge electrode onto said surface of said receiving medium.

11. A method as in claim 10 wherein said printing fluid is selected from the group consisting of ink, liquids, toner particles, fine particulate matter suspended in air or liquid, adhesives, molten material, and organic material.

12. A method as in claim 10 wherein step (f) comprises performing steps (c), (d), and (e) with at least one other nozzle, and with at least one other printing fluid, so that a plurality of printing fluids are deposited on said receiving medium.

13. A method as in claim 12 wherein each of said nozzles is electrically insulated from each other of said nozzles, so that a separate electrical charge can be applied to said printing fluid in each of said nozzles.

14. A method as in claim 13, further comprising the step of providing relative movement between said corona discharge electrode and said receiving medium.

15. A method as in claim 13, further comprising the step of providing relative movement between said corona discharge electrode and said receiving medium.

16. A method as in claim 13, further comprising the step of providing relative movement between each said nozzle and said receiving medium.

17. A method as in claim 13, further comprising the step of applying heat to said printing fluid.

18. A method as in claim 13, further comprising the step of applying heat to said receiving medium.

19. A method as in claim 13, wherein said receiving medium is selected from the group consisting of paper, transparencies, metals, ceramics, plastics, textiles, and semiconductors.

20. A method as in claim 12 wherein said printing fluid is selected from the group consisting of ink, liquids, toner particles, fine particulate matter suspended in air or liquid, adhesives, molten material, and organic material.

21. An ink jet printer, comprising:

at least one nozzle for dispensing a printing fluid;

a receiving medium having a surface facing said at least one nozzle;

a support for holding said receiving medium;

a first source of electrical charge having a polarity P1 for depositing a uniform electrical charge of said polarity P1 onto said surface of said receiving medium;

at least one pulsed voltage source for applying an electrical charge so as to cause said printing fluid to be controllably deposited on said receiving medium;

a second source of electrical charge of a polarity P2 opposite to said polarity P1 for depositing a uniform electrical charge of said polarity P2 onto said surface of said receiving medium.

22. A printer as in claim 21, wherein said first source of electrical charge comprises a first electrode.

23. A printer as in claim 22 wherein said second source of electrical charge also comprises said first electrode.

24. A printer as in claim 22 wherein said second source of electrical charge comprises a second electrode.

25. A printer as in claim 24 wherein said first electrode comprises a first corona discharge electrode and said second electrode comprises a second corona discharge electrode.

26. A printer as in claim 22 wherein said first electrode comprises a corona discharge electrode.

27. A printer as in claim 22 wherein said first electrode comprises a corotron.

28. A printer as in claim 22 wherein said first electrode comprises a scorotron.

29. A printer as in claim 21, wherein said first source of electrical charge comprises a tribocharger.

30. A printer as in claim 21 comprising:

at least two nozzles; and at least two pulsed voltage sources;

wherein each of said nozzles is electrically insulated from each of the other nozzles, a separate electrical connection being made between said printing fluid in each of said nozzles and one of said pulsed voltage sources.

31. A printer as in claim 30 wherein said printing fluid in a first one of said nozzles is of a first color and said printing fluid in a second of said nozzles is of a second color.

32. A method of depositing a printing material onto a receiving medium comprising the steps of:

providing a nozzle containing a supply of said printing material;

depositing a uniform electrical charge of a polarity P1 onto a surface of said receiving medium;

applying an electrical charge of a polarity P2 opposite to said polarity P1 to said printing material in said nozzle thereby establishing an attractive electrostatic force between said receiving medium and said printing material and causing a first dot of said printing material to be attracted to and deposited onto said receiving medium;

depositing additional electrical charge of said polarity P1 onto said surface and said first dot, said additional electrical charge creating a spatially uniform charge of said polarity P1 on said first dot and a region of said surface adjacent said first dot; and causing a second dot of said printing material to be deposited onto said first dot or said region of said surface adjacent said first dot, said second dot being charged to said polarity P2.

33. A method as in claim 32 wherein the step of depositing a uniform electrical charge of a polarity P1 comprises depositing electrical charge with a corona discharge electrode.

34. A method as in claim 32 wherein the step of depositing a uniform electrical charge of a polarity P1 comprises depositing electrical charge with a tribocharger.

35. A method as in claim 32 wherein said receiving medium is electrically nonconductive such that said first dot remains charged to said polarity P2 until said step of depositing additional electrical charge of said polarity P1 onto said surface and said first dot is performed.

36. A method as in claim 32 wherein said receiving medium is electrically conductive such that a dipole is formed within said first dot, said dipole comprising a region of charge of said polarity P1 adjacent an exterior surface of said dot and a region of charge of said polarity P2 adjacent an interface between said dot and said surface of said receiving medium.

37. A method as in claim 32 wherein said second dot is a different color from said first dot.

38. A method for printing in claim 37, further comprising the step of:

(d) performing steps (a), (b) and (c) at least one additional time.

39. A method as in claim 37, wherein said printing fluid is selected from the group consisting of ink, liquids, toner particles, fine particulate matter suspended in air or liquid, adhesives, molten material, and organic material.

40. A method as in claim 37, wherein said receiving medium is selected from the group consisting of paper, transparencies, metals, ceramics, plastics, textiles, and semiconductors.

41. A method for printing, comprising the following steps performed in the order set forth:

(a) depositing a uniform electrical charge of polarity P1 onto one surface of a receiving medium;

(b) depositing a uniform electrical charge of polarity P2 opposite to said polarity P1 onto said surface of said receiving medium; and (c) applying an electrical charge of said polarity P1 to a printing fluid in a nozzle, so as to cause said printing fluid to be attracted to and deposited on said receiving medium.

42. A method for printing in claim 41, further comprising the step of:

(d) performing steps (a), (b) and (c) at least one additional time.

43. A method for printing in claim 42, wherein step (d) is performed with at least one other nozzle, so that printing fluid from at least two nozzles are deposited on said receiving medium.

44. A method as in claim 41, wherein step (d) is performed with at least one other nozzle, and with at least one other printing fluid, so that a plurality of printing fluids are deposited on said receiving medium.

* * * * *